United States Patent [19]

Norton

[11] 4,445,286

[45] May 1, 1984

[54] FOOTWEAR, SUCH AS ATHLETIC SHOE

[75] Inventor: Edward J. Norton, Kingston, N.H.

[73] Assignee: New Balance Athletic Shoe, Inc., Boston, Mass.

[21] Appl. No.: 312,756

[22] Filed: Oct. 19, 1981

[51] Int. Cl.[3] ..... A43B 13/04; A43B 23/28

[52] U.S. Cl. ..... 36/32 R; 36/59 C

[58] Field of Search ..... 36/32 R, 59 R, 59 C; D2/320, 321

[56] References Cited

U.S. PATENT DOCUMENTS 4,309,376 1/1982 Veno et al. ..... 36/32 R

FOREIGN PATENT DOCUMENTS 1760262 7/1971 Fed. Rep. of Germany ..... 36/32 R 2116488 10/1972 Fed. Rep. of Germany ..... 36/32 R 2402425 5/1979 France ..... 36/32 R

*Primary Examiner*—Patrick D. Lawson

*Attorney, Agent, or Firm*—Pennie & Edmonds

[57] ABSTRACT

An athletic shoe adapted for field sports, such as football, baseball, softball and the like including a plurality of raised elements integral with and extending from the sole portion of the footwear is disclosed. A substantial majority of the raised elements are located in individual, spaced groups of interlocking raised elements and upon flexing of the sole portion during each step and repeated cycles of foot movement collected debris from between individual groups of raised elements and between the interlocking raised elements of each group will release and separate from the sole portion.

7 Claims, 5 Drawing Figures

FOOTWEAR, SUCH AS ATHLETIC SHOE

DESCRIPTION

1. Technical Field

The present invention relates to footwear. The invention particularly relates to an athletic shoe adapted for field sports, such as football, baseball, softball and the like including a plurality of raised elements integral with and extending from the sole portion of the footwear. A substantial majority of the raised elements are located in individual, spaced groups of interlocking raised elements and upon flexing of the sole portion during each step and repeated cycles of foot movement collected debris from between individual groups of raised elements and between the interlocking raised elements of each group will release and separate from the sole portion.

2. Background Art

The prior art includes footwear of many forms and types, such as athletic shoes having traction means extending from or formed within the sole portion of the footwear. Typically these traction means may be characterized by cleats for football and soccer, spikes for track, golf and baseball, contoured or grooved surfaces of the sole portion for running and jogging, as well as other forms of traction means for other specialized sporting endeavors.

As may be well-known, the degree of traction one may develop between the footwear and the surface is, in part, dependent upon the ability to prevent debris in the form generally of dirt, grass, and so forth from collecting within the surface area of the sole portion of the footwear or between each of the several elements which project outwardly from the surface area. It is not an uncommon occurrence during athletic endeavors particularly under circumstances that the field or other surface is wet that the athlete will stop and clean collected clogs of debris from the traction means whether they be cleats, spikes or any other form of traction means whose function is to enhance the degree of traction developed between the footwear and the surface.

Up to the present time, footwear of the types previously mentioned and other known types of footwear for athletic use, have had no ability to continuously provide a good measure of traction between the footwear and the surface under conditions previously mentioned. This incapability of shedding collected clogs of debris from the traction means has proven to be a problem in footwear of this type, and unless the footwear is cleaned of collected debris the problem results in repeated incidents of slippage during use.

SUMMARY OF THE INVENTION

The footwear of the present invention, adapted for field sports, such as football, baseball, softball and the like, is an improvement over footwear of the prior art. As a specific aspect, the footwear seeks to overcome the problems and disadvantages of prior art footwear, particularly that footwear used in field sports, with regard to the failure or diminishing capability of traction under circumstances that the field is wet and soggy.

The footwear of the present invention includes a sole portion, an upper portion attached to the sole portion providing a foot receiving openings, with the sole portion being characterized by a plurality of raised elements extending from a base within substantially the plane of the outer surface of the sole portion. A substantial majority of the raised elements are located in individual groups of interlocking raised elements spaced in substantially mutually perpendicular orientations within the area of the outer surface. The sole portion is also characterized by the material from which it is formed, namely a material capable of flexure during each step and repeated cycles of foot movement, whereby collected debris between individual groups of raised elements and between the interlocking raised elements of each group may release and separate from the sole portion as the individual groups and the interlocking raised elements of each group moved relative to one another. This self-shedding characteristic is important in footwear for athletic use.

According to a more specific aspect of the present invention, each raised element generally is in the form of a polyhedron including a plurality of generally triangular faces which extend from the base to a truncated end. Each of the raised elements may include a plurality of four sides with one pair of opposed sides being of greater length at the base than the other pair of opposed sides. According to a preferred embodiment of the invention the individual groups of raised elements include a plurality of four raised elements in an arrangement whereby three of the raised elements are situated with their opposed sides of greater length in abutting relation. The raised elements are formed with the truncated end at a skew from the center of the base. The outer raised elements of the three aligned raised elements both face in one direction, while the inner raised element of the group and the fourth of the raised elements both face in the opposite direction. The individual groups of raised elements are aligned and oriented to the surface of the outer sole in a position such that the sides of each raised element of greater length generally extend parallel to the longitudinal axis of the footwear. The groups of raised elements in each adjacent row, further, are staggered and oppositely orientated.

The sole portion of the footwear may be formed of a vulcanized, carbon loaded rubber composition capable of flexing during each step and repeated cycles of foot movement thereby to provide a self-shedding capability which functions to maintain continuous and unusually good capability of traction between the footwear and the surface.

Other important advantages and characteristics of the invention will become clear as the description, to be considered in conjunction with the drawing, continues.

BEST MODE FOR CARRYING OUT THE INVENTION

The footwear 10 of the present invention illustrated as an athletic shoe adapted for field sports, such as football, baseball, softball and the like includes an upper portion 12 and a sole portion 14. Features of the upper portion, the sole portion, aside from the specific features of the sole portion to be discussed below, and the manner of joining the upper portion, sole portion, counter, insole and so forth may be considered conventional.

Figure 1:
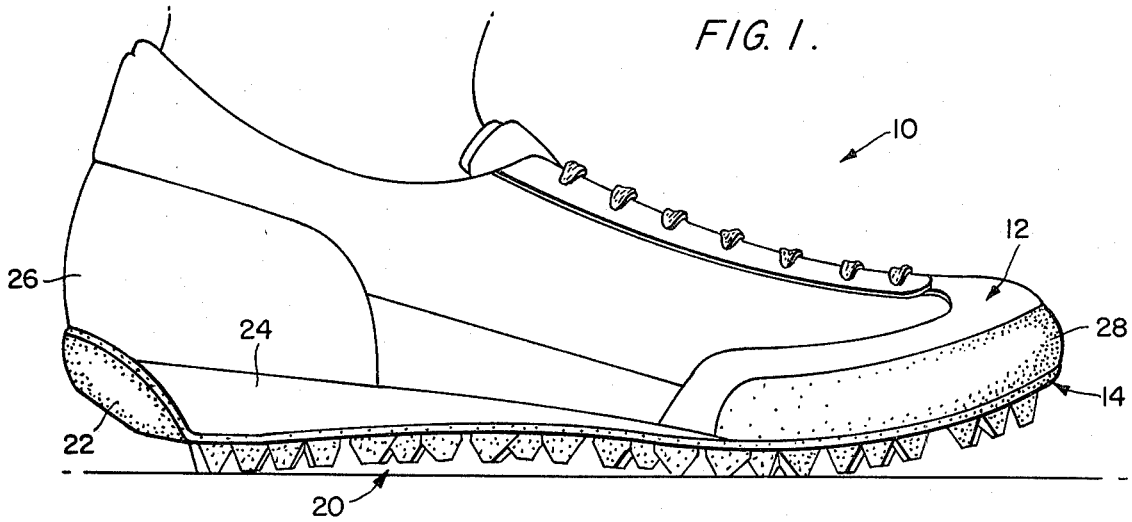
FIG. 1 is a view in elevation of the footwear from either the medial or lateral side.
Figure 2:
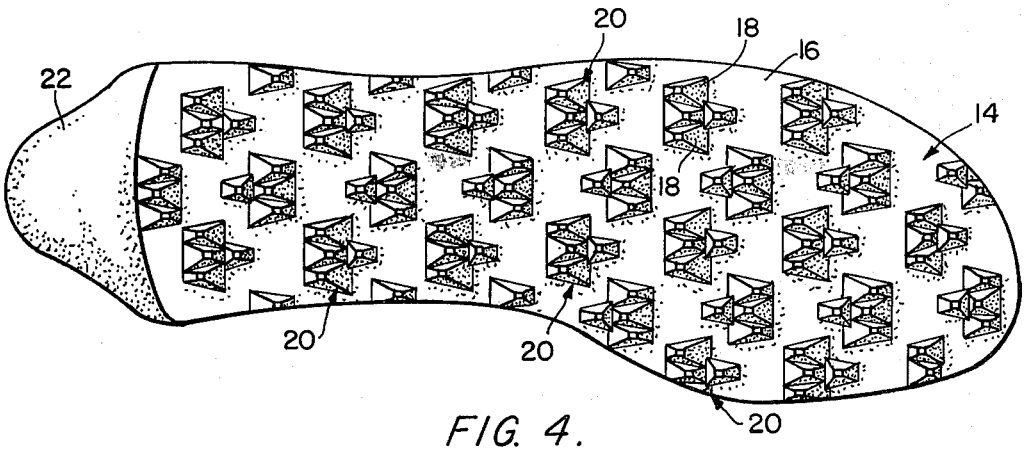
FIG. 2 is a bottom view of the sole portion of the footwear.
Figure 3:
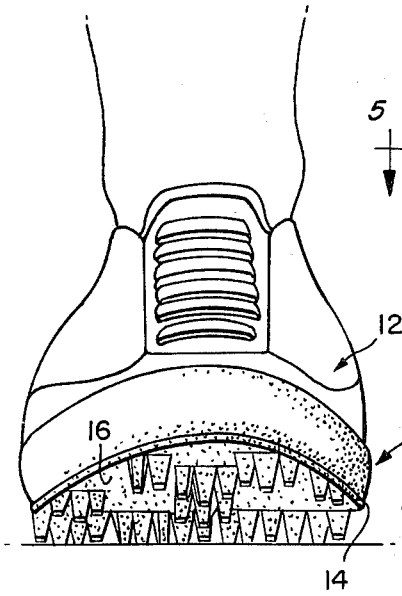
FIG. 3 is a front elevational view of the footwear.

The sole portion 14, as perhaps best seen in FIG. 2, includes an outer surface 16 extending at least throughout an area from the toe of the footwear to the heel as well as from the medial side of the footwear to the lateral side. A plurality of raised elements 18 arranged in individual groups 20 of raised elements are supported by the outer surface which otherwise is substantially flat throughout a major extent of the sole portion. The individual groups of raised elements are substantially equidistantly spaced along a plurality of rows, which rows, in turn, are substantially equidistantly spaced apart. The groups of raised elements in each row extend substantially parallel to the longitudinal axis of the footwear and adjacent rows are staggered thereby to locate each group of raised elements in one row between the groups of raised elements in adjacent rows.

Figure 4:
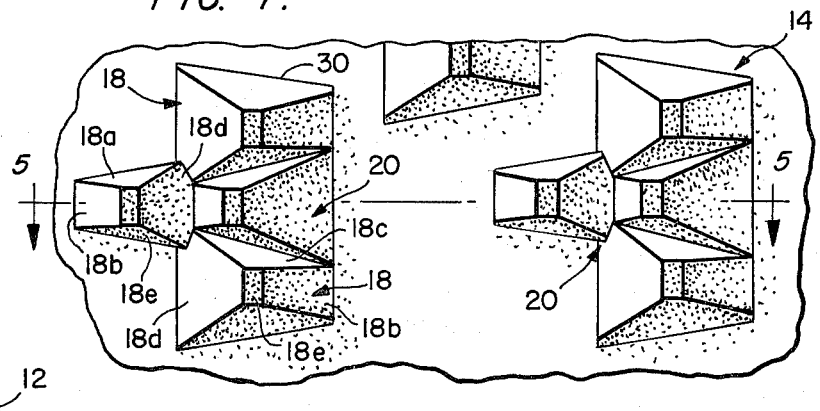
FIG. 4. is an enlarged view of a portion of the sole portion of the footwear as illustrated in FIG. 2.

Referring to FIG. 4, the raised elements 18 of two groups 20 are illustrated in a scale significantly increased from the scale of FIG. 2 for purposes of gaining a better understanding of the structural makeup of each raised element. As illustrated in the Figure, referring to the groups which are completely illustrated, there is a plurality of four raised elements, each of which generally is in the form of a polyhedron including a plurality of four triangular sides 18*a, b, c* and *d* extending toward a substantially truncated upper end 18*e*. The dimension along the base of one pair of opposed sides (18*a* and 18*c*) extends throughout a length somewhat longer than the length of the dimension along the base of the other pair of opposed sides (18*b* and 18*d*) and, as illustrated in the Figures, each group includes a subgrouping of three raised elements arranged in side-by-side relation along the long dimension. The last of the raised elements is arranged in end-to-end relation to form a second subgrouping with the center raised element of the first-mentioned subgrouping.

With continued reference to FIG. 4, it will be seen that the truncated end 18*e* of each raised element 18 is located somewhat skewed from the center of the base so that there is a slight suggestion that the raised elements are angled toward one end or the other. In the form of the invention illustrated in the Figures, the raised elements of the second subgrouping are angled in one direction and the outer raised elements of the first-mentioned subgrouping are angled in the other direction. More particularly, the raised elements present the suggestion of being skewed toward the side 18*b*.

As previously indicated, the groups of raised elements in one row are staggered between the groups of raised elements in adjacent rows and further, the groups of raised elements in the one row are arranged in a disposition the reverse of the arrangement of the groups of raised elements in the adjacent rows. The arrangement of the groups of raised elements within the outer surface 16, the arrangement of the raised elements of each group and the orientation of the truncated upper ends 18*e* both skewed to the base of the raised element and generally transverse to the longitudinal axis of footwear 10 provides a good measure of stability for the footwear upon a supporting surface.

As illustrated in FIG. 2, a substantial majority of groups of raised elements are defined by the makeup previously discussed. However, a small minority of groups of raised elements may be differently characterized as a result of the particular size of the outer surface 16 and the particular area within the sole portion from which it extends. Thus, the group of raised elements located to the heel of the footwear only includes the first-mentioned subgrouping. Inclusion of the second subgrouping possibly would decrease stability of the footwear 10 in that the last of the raised elements might act as a fulcrum point leading to an added measure of pronation during a cycle of movement of the foot.

The portion of the outer surface 16 of the sole portion 14 to the rear of the last-mentioned group of raised elements at 22 is somewhat roughened, raised up and partially around a portion of the insole 24 and counter 26 of the footwear, and secured in position. The outer surface of the sole portion at 28 within the region of and around the toe extending rearwardly toward the instep of the foot on both the medial and lateral side similarly is roughened, raised upwardly and partially around the upper portion 12, and secured to the upper portion in any conventional manner. For example, the roughened portions may be cemented and/or stitched to the underlying portion of footwear 10.

Figure 5:
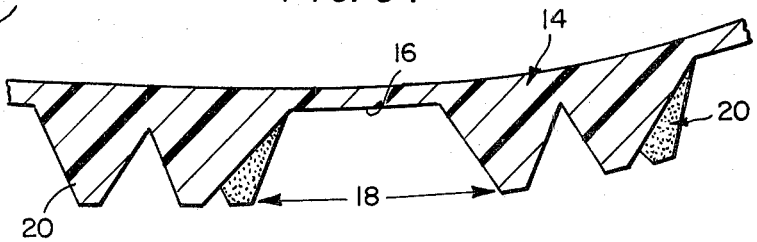
FIG. 5 is a view in section as seen along the line 5—5 in FIG. 4 illustrating the capability of flexure of the sole portion and of individual raised elements in a group of raised elements carried by the sole portion.

It is an important aspect of the present invention to provide for the break and release of collected debris in the form of mud, dirt, or grass as the footwear is flexed with each step and during each cycle of foot movement to provide continuous and unusually good traction with a surface. In the use of the footwear as the sole portion is flexed with each step and during each cycle of foot movement, there is a consequent separation or movement of groups of raised elements relative to adjacent groups and, in addition, movement of the raised elements in each individual group relative to other raised elements in the group. To this end, as illustrated in FIGS. 4 and 5, the raised elements of individual groups of raised elements extending from a relatively thin base 30 tend to pivot both toward and away from one another, and, in similar fashion, the individual groups of raised elements tend to pivot both toward and away from adjacent groups. Thus, it may be considered that these movements of structure act on the collected debris to effectively compress and then expel the debris, such as squeezing the debris from between the raised elements of a group and between groups of raised elements thereby to achieve the desired end of continuous and unusually good traction.

The sole portion 14 of the footwear may be formed of a rubber composition, and it is possible to form the sole portion of polyurethane. Preferably, however, the sole porton is formed of vulcanized, carbon loaded rubber, and footwear using a sole portion and integral raised elements 18 of this type has been used successfully.

I claim:

1. Footwear of the type adapted for field sports, such as football, baseball, softball and the like comprising a sole portion, an upper portion attached to said sole portion providing a foot receiving opening, and wherein said sole portion is characterized by a plurality of raised elements integral with said sole portion extending from a base within substantially the plane of the outer surface of said sole portion, a substantial majority of said raised elements located in individual groups of interlocking raised elements in substantially mutually perpendicular orientation and spaced from other groups of interlocking raised elements within the area of said outer surface, said sole portion further characterized by being formed of a material capable of flexure during each step and repeated cycles of foot movement whereby collected debris between individual groups of raised elements and between said interlocking raised elements of each said group may release and separate from said sole portion.

2. The footwear of claim 1 wherein said substantial majority of said raised elements are located in individual groups of four raised elements.

3. The footwear of claim 1 or 2 wherein each said raised element is in the form of a polyhedron extending from said base to a substantially truncated end, and wherein said base includes a pair of opposed sides of greater dimension than the other pair of opposed sides.

4. The footwear of claim 1 wherein said opposed sides of greater dimension generally extend parallel to the longitudinal axis of said footwear, and the orientation of said raised elements in each row of individual groups along said axis being reversed.

5. The footwear of claim 1 wherein said sole portion is formed of a composition rubber material.

6. The footwear of claim 3 wherein the truncated end of each raised element is somewhat skewed toward either the heel or toe of said footwear for added stability.

7. Footwear of the type adapted for field sports, such as football, baseball, softball and the like comprising a sole portion, an upper portion attached to said sole portion providing a foot receiving opening, and wherein said sole portion is characterized by a plurality of raised elements in the form of a polyhedron integral with said sole portion extending from a base having one pair of opposed sides of greater dimension than the other pair of opposed sides within substantially the plane of the outer surface of said sole portion to a substantially truncated end, a substantial majority of said raised elements located in individual groups including a plurality of four interlocking raised elements spaced in substantially mutually perpendicular orientation within the area of said outer surface and in an arrangement whereby three of said raised elements are situated with their opposed sides of greater dimension in abutting relation, the out of raised elements facing in one direction and both the inner raised elements and the fourth raised element facing in opposite direction, said sole portion further characterized by being formed of a material capable of flexure during each step and repeated cycles of foot movement whereby collected debris between individual groups of raised elements and between said interlocking raised elements of each said group may release and separate from said sole portion.

* * * * *